US009803284B2

(12) United States Patent
Divigalpitiya

(10) Patent No.: US 9,803,284 B2
(45) Date of Patent: Oct. 31, 2017

(54) METHOD OF DEPOSITING TITANIA ON A SUBSTRATE AND COMPOSITE ARTICLE

(71) Applicant: 3M INNOVATIVE PROPERTIES COMPANY, St. Paul, MN (US)

(72) Inventor: Ranjith Divigalpitiya, London (CA)

(73) Assignee: 3M Innovative Properties Company, St. Paul, MN (US)

( * ) Notice: Subject to any disclaimer, the term of this patent is extended or adjusted under 35 U.S.C. 154(b) by 154 days.

(21) Appl. No.: 14/888,245

(22) PCT Filed: Apr. 23, 2014

(86) PCT No.: PCT/US2014/035170

§ 371 (c)(1),
(2) Date: Oct. 30, 2015

(87) PCT Pub. No.: WO2014/182457

PCT Pub. Date: Nov. 13, 2014

(65) Prior Publication Data

US 2016/0076151 A1 Mar. 17, 2016

Related U.S. Application Data

(60) Provisional application No. 61/821,923, filed on May 10, 2013.

(51) Int. Cl.

| | |
|---|---|
| ***B32B 9/00*** | (2006.01) |
| ***B05D 1/12*** | (2006.01) |
| ***C23C 24/02*** | (2006.01) |
| ***B24B 1/00*** | (2006.01) |

(52) U.S. Cl.
CPC ..... *C23C 24/02* (2013.01); *B24B 1/00* (2013.01)

(58) Field of Classification Search
CPC ..... B24B 1/00; C23C 24/02
USPC ..... 428/472; 427/180
See application file for complete search history.

(56) References Cited

U.S. PATENT DOCUMENTS

| | | | | |
|---|---|---|---|---|
| 3,369,268 | A | 2/1968 | Burns | |
| 4,741,918 | A | 5/1988 | Nagy de Nagybaczon | |
| 6,511,701 | B1 | 1/2003 | Divigalpitiya | |
| 8,178,241 | B2 | 5/2012 | Divigalpitiya | |
| 2008/0241573 | A1* | 10/2008 | Askin | B05D 5/08 428/613 |

(Continued)

FOREIGN PATENT DOCUMENTS

| | | |
|---|---|---|
| CA | 2150320 | 11/1996 |
| EP | 0411413 | 2/1991 |

(Continued)

OTHER PUBLICATIONS

Zhu, "Interface diffusion and reaction between Ti02 film photocatalyst and aluminium alloy substrate", Surface and Interface Analysis, 2001, vol. 32, pp. 218-223.*

(Continued)

*Primary Examiner* — William Cheung
(74) *Attorney, Agent, or Firm* — Bradford B. Wright

(57) ABSTRACT

A method comprises rubbing a powder comprising titanium dioxide particles against a surface of an aluminum substrate to form a layer bonded to the surface of the aluminum substrate. The powder comprises titanium dioxide and is essentially free of organic particles. Composite articles preparable by the method are also disclosed.

9 Claims, 5 Drawing Sheets

(56) References Cited

U.S. PATENT DOCUMENTS

2009/0311513 A1 12/2009 Hu

FOREIGN PATENT DOCUMENTS

| | | |
|---|---|---|
| WO | WO 94/25641 | 11/1994 |
| WO | WO 99/61540 | 12/1999 |

OTHER PUBLICATIONS

Li et al, "Preparation and Properties of nano-$TiO_2$ Photo-catalytic coating film", Materials Review, Dec. 24, 2005, 19(5): pp. 120-124.
O'Regan, "A low-cost, high-efficiency solar cell based on dye-sensitized colloidal TiO2 films". Nature, Oct. 24, 1991, vol. 353, pp. 737-740.
International Search Report for PCT International Application No. PCT/US2014/035170, dated Aug. 5, 2014, 4pgs.
Zhang, Yonggang, et al., "Structural Intermetallics", National Defense Industry Press, dated Jan. 2011, pp. 144-145.
He Kai-xuan et al., "Field Emission and Their Application in Ionization Gauge of CNTx=TiO2 Films", Vacuum Electronics, vol. 1, No. 5, dated Oct. 24, 2011, pp. 37-42.

* cited by examiner

METHOD OF DEPOSITING TITANIA ON A SUBSTRATE AND COMPOSITE ARTICLE

This application is a U.S. National stage application of PCT/US2015/028301, which was filed on Apr. 29, 2015, as a PCT International Patent application and claims priority to U.S. Provisional patent application No. 61/986,405, filed Apr. 30, 2014, the entire disclosures of which are incorporated by reference in their entirety.

TECHNICAL FIELD

The present disclosure broadly relates to methods of forming titanium dioxide-containing coatings on a substrate and composite articles preparable thereby.

BACKGROUND

Titanium dioxide (i.e., $TiO_2$ or titania) is a multi-functional material that has attracted extensive research and development efforts in the last two decades. It has applications in energy and environmental fields in addition to its traditional usage as a white pigment. Some applications of $TiO_2$ include gas sensors, electrochromic devices, dye-sensitized solar cells, and photocatalysts.

Various photocatalysts have been developed using $TiO_2$ and applied to fields such as air/water purification, self-cleaning, anti-fogging (hydrophilic/hydrophobic switching), sterilization, and hydrogen production through water-splitting. Two properties of $TiO_2$ that influence its application are its crystal structure and surface morphology. Usually, a "nanocrystalline" structure is ideal for $TiO_2$ films to achieve high functional performance. This is because i) the high specific surface area provides superior surface activity when the particles are of nanometer-scale dimensions; and ii) catalytic activity is sensitively associated with the crystallinity of individual nanoparticles, and good crystallinity (in anatase, brookite, or rutile structures) is generally desired.

Known methods for depositing $TiO_2$ films include various vacuum deposition techniques (e.g., physical vapor deposition (PVD), chemical vapor deposition (CVD), pulsed laser deposition (PLD), and sputtering), and solvent or aqueous-based methods in which titanium dioxide dispersions are coated and then dried. The vacuum deposition techniques require expensive specialized equipment that is typically not well-suited for preparing thick coatings at a high production rate. In contrast, liquid based coating methods require energy to remove the liquid and may result in coatings having impurities that adversely affect properties (e.g., photocatalytic properties) of the $TiO_2$ layer.

SUMMARY

The present disclosure overcomes the problems of cost and/or liquid handling by providing an alternative method for making $TiO_2$ containing inorganic layers on aluminum substrates by a simple rubbing method.

In one aspect, the present disclosure provides a method comprising rubbing a powder comprising titanium dioxide particles against a surface of an aluminum substrate to form a layer bonded to the surface of the aluminum substrate, wherein the powder is essentially free of organic particles, and wherein the layer comprises titanium dioxide.

Unexpectedly, the present inventor has found that inorganic layers prepared according to the present disclosure may contain minor amounts of elemental titanium, particularly near the surface of the aluminum substrate.

Accordingly, in another aspect, the present disclosure provides a composite article comprising a layer bonded to a surface of a substrate, wherein the powder is essentially free of organic components, and wherein the layer comprises titanium dioxide and elemental titanium, wherein the substrate comprises aluminum metal.

The following definitions apply throughout the specification and claims.

The term "aluminum substrate" refers to a substrate comprising mostly aluminum metal, and typically having a thin aluminum oxide layer formed on exposed surfaces.

The term "essentially free of" means containing less than one percent by weight of, and may be less than 0.1 percent by weight of, less than 0.01 percent by weight of, or even completely free of.

The term "inorganic" refers to compounds and materials that are not organic.

The term "organic" includes compounds and materials containing carbon-hydrogen C—H covalent bonds and/or carbon-carbon multiple bonds (i.e., C—C bonds having a bond order greater than one). Accordingly, graphite, graphene, fullerenes, and carbides are considered as organic, while sodium carbonate and urea would be considered inorganic.

The term "organic particle" refers to a particle that includes more than an adventitious amount (e.g., less than 0.1 percent by weight or less than 0.01 percent by weight) of organic material.

The term "powder" refers a solid substance in the form of tiny loose particles.

Features and advantages of the present disclosure will be further understood upon consideration of the detailed description as well as the appended claims.

Figure 1:
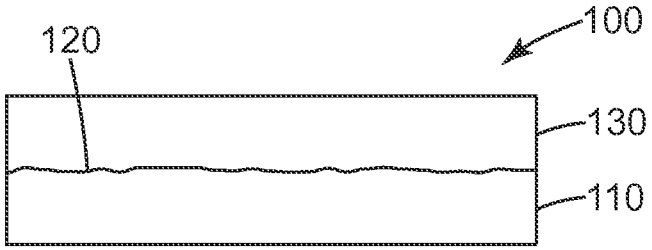
FIG. 1 is a schematic side view of exemplary composite article 100 according to the present disclosure.
Figure 2A:
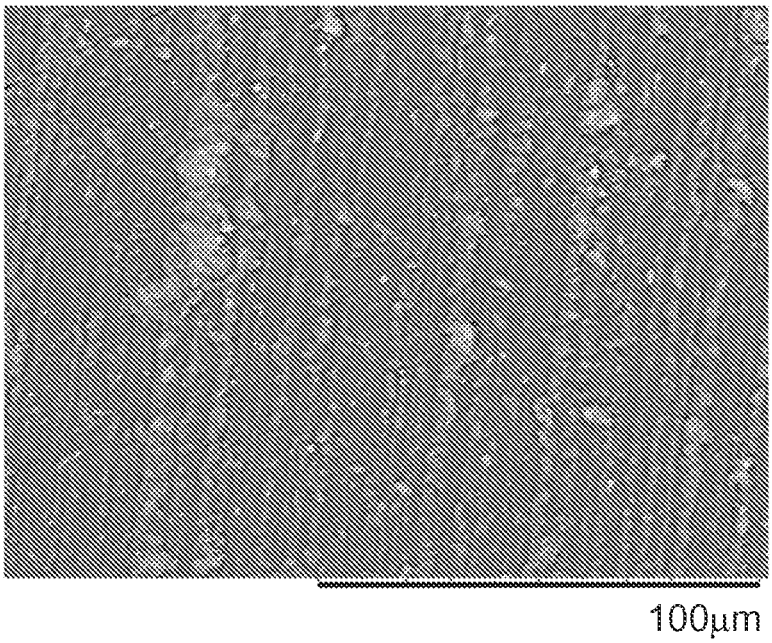
FIGS. 2A-2E show scanning electron microscopy (SEM) micrographs of the coatings from Examples 1A-1E, respectively.
Figure 2B:
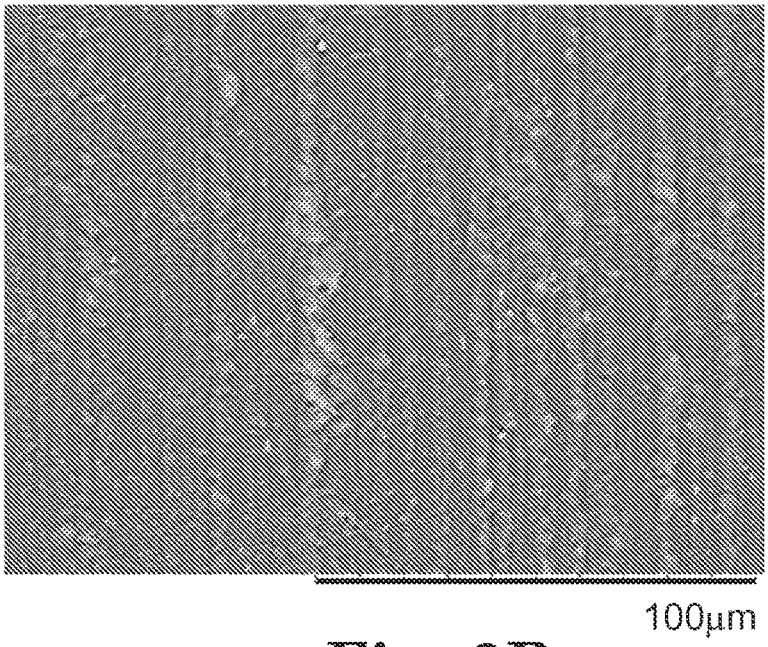
Figure 2C:
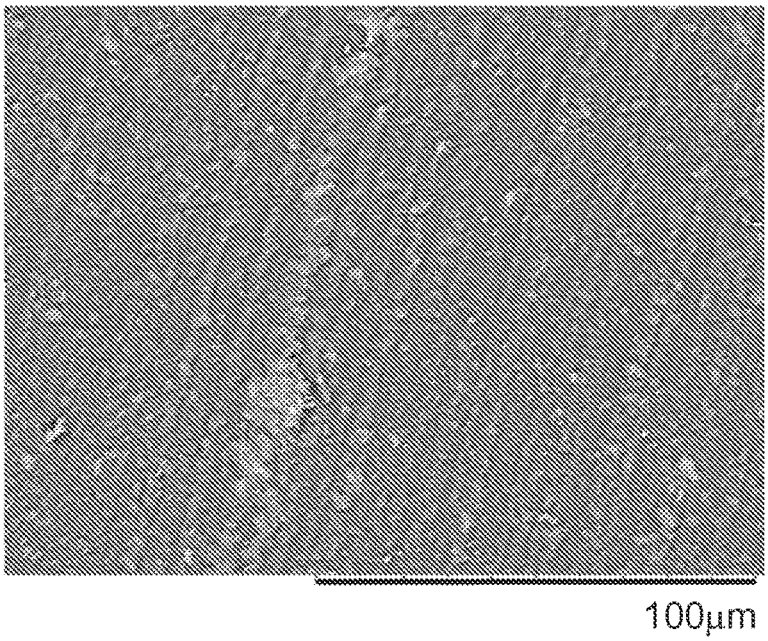
Figure 2D:
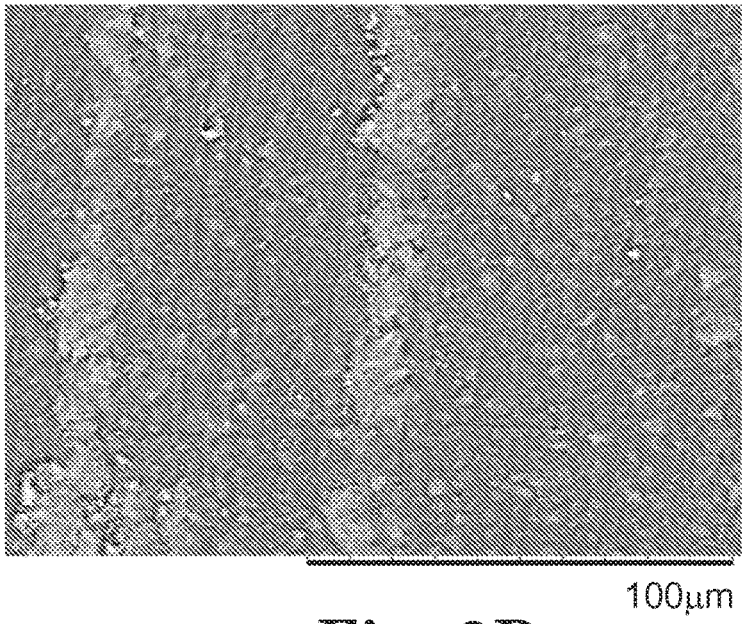
Figure 2E:
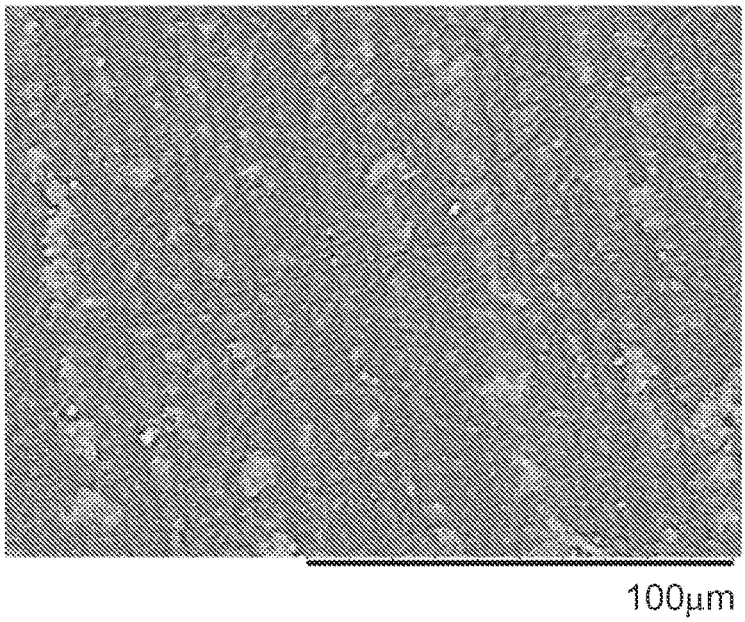

It should be understood that numerous other modifications and embodiments can be devised by those skilled in the art, which fall within the scope and spirit of the principles of the disclosure. The figures may not be drawn to scale.

DETAILED DESCRIPTION

Methods according to the present disclosure involve rubbing powder against a surface of an aluminum substrate to form a layer bonded to the surface of the aluminum substrate.

The powder comprises titanium dioxide particles. The titanium dioxide particles may be of any crystalline form, or a combination of crystalline forms. Crystalline forms of titanium dioxide include anatase, rutile, brookite, synthetically produced metastable titanium dioxide (monoclinic, tetragonal and orthorhombic), and high-pressure forms (e.g., having $\alpha$-PbO2-like, baddeleyite-like, cotunnite-like, orthorhombic OI, or cubic phases). For applications wherein photocatalytic properties are desired the titanium dioxide preferably has a high content of anatase and/or rutile. For example, the titanium dioxide may comprise at least 50, 55, 60, 65, 70, 75, 80, 85, 90, 95, 98, or even at least 99 percent by weight of anatase and/or rutile. In some embodiments, the titanium dioxide consists essentially of anatase and/or rutile.

The powder may comprise additional inorganic components (e.g., as may result from refining of ilmenite ore), but preferably, the powder comprises at least 50, 55, 60, 65, 70, 75, 80, 85, 90, 95, 98, or even at least 99 percent of titanium dioxide, or more. Preferably, consists essentially of one or more metal oxides and/or hydrates thereof. Preferably, the powder is essentially free of water, although this is not a requirement.

The titanium dioxide particles preferably have a median particle size ($D_{50}$) in the range of 10 to 1000 nanometers, more preferably 50 to 800 nanometers, and more preferably 100 to 700 nanometers, although other sizes may also be used.

The aluminum substrate may have any form. Examples include ingots, rods, slabs, films, foils, strips, cast parts, extruded stock, sheet stock, and plates. Of these aluminum sheets and foil is especially preferred, for example, due to its cost, weight, and ease of use in continuous manufacturing processes. In some embodiments, the aluminum substrate may comprise a portion of an aircraft skin.

The aluminum substrate has a surface against which the powder is rubbed. The surface may be smooth or rough (e.g., having grooves formed by rollers in the manufacturing process or pores formed by anodizing). Unexpectedly, the present inventor has found that the presence of surface roughness improves physical properties of the inorganic layer.

Under ordinary circumstances, aluminum has an aluminum oxide layer disposed on exposed surfaces. The layer may become intermixed with the powder during abrading and form a portion of the inorganic layer, although this is not a requirement.

Rubbing of the powder against the surface of the aluminum substrate may be accomplished by any suitable means including manual and/or mechanical methods.

In one exemplary method, an electric orbital sander such as, for example, a Black and Decker model 5710 electric orbital sander (Black and Decker, New Britain, Connecticut) with 4000 orbital operations per minute and a concentric throw of 0.1 inch (0.2 inch overall) may be used. Preferably, the concentric throw of the orbital sander pad is greater than about 0.05 inch (0.1 inch overall). Air-powered orbital sanders such as an Ingersoll-Rand, Model 312 air-powered orbital sander (Ingersoll-Rand, Dublin, Ireland) having operational speeds and concentric throw similar to the above-described Black and Decker model 5710, and with a free speed of 8000 operations per minute at 90 psi air pressure are also useful for carrying out the present disclosure. With reduced air pressure supplied and increased application pressure the actual operating speeds are in the 0 to 4000 operations per minute range. Combinations of random orbital sanders (e.g., in series on a web line) may be used. Rotary buffers may also be used. One exemplary production apparatus suitable for carrying out methods according to the present disclosure is described in U.S. Pat. No. 6,511,701 (Divigalpitiya et al.).

Sanders and/or buffers are generally used in combination with a buffing/polishing pad or bonnet adapted for use with the particular sander and/or buffer. Suitable buffing/polishing pads are widely available, for example, from the equipment manufacturers.

An exemplary paint applicator pad that can be mounted on a sander and used in methods according to the present disclosure is described in U.S. Pat. No. 3,369,268 (Burns et al.). These paint applicators are a laminate construction of a thin metal backing, a layer of open-celled polyurethane foam with an active surface of soft, very fine, densely piled nylon bristles. The pads can be modified such that they can be easily mounted to orbital sanders and polishers.

After rubbing the powder against the surface of the aluminum substrate, excess loose and/or unbound powder may be removed by any suitable (preferably liquid free) method such as, for example, by light brushing or using compressed air.

After rubbing the powder against the surface of the aluminum substrate, a layer is formed on the surface of the aluminum substrate. Referring now to FIG. 1, exemplary composite article 100 comprises aluminum substrate 110 with surface 120 having layer 130 disposed thereon. Layer 130 comprises titanium dioxide, typically in the same crystalline form as the titanium dioxide the powder used to form it. Accordingly, the layer may comprise titanium dioxide of have any crystalline form, or a combination of crystalline forms such as, for example, anatase, rutile, brookite, synthetically produced metastable titanium dioxide (monoclinic, tetragonal and orthorhombic), and high-pressure forms (e.g., having α-PbO2-like, baddeleyite-like, cotunnite-like, orthorhombic OI, or cubic phases). For applications wherein photocatalytic properties are desired the titanium dioxide preferably has a high content of anatase and/or rutile. For example, the titanium dioxide may comprise at least 50, 55, 60, 65, 70, 75, 80, 85, 90, 95, 98, or even at least 99 percent by weight of anatase and/or rutile. In some embodiments, the titanium dioxide consists essentially of anatase and/or rutile.

The layer may comprise additional inorganic components (e.g., as may result from refining of ilmenite ore), but preferably, the powder comprises at least 50, 55, 60, 65, 70, 75, 80, 85, 90, 95, 98, or even at least 99 percent of titanium dioxide, or more. Preferably, the layer consists essentially of one or more metal oxides (e.g., titanium dioxide and optionally aluminum oxide) and/or hydrates thereof. Preferably, the layer is essentially free of organic components, although this is not a requirement. The titanium dioxide in the layer may or may not have a particulate appearance. In some embodiments, the layer is substantially uniform and complete over that portion of the surface of the aluminum substrate where it is applied, while in other embodiments the layer may be uneven and/or discontinuous. Typically, the layer has a thickness in a range of from 0.5 nanometers to one micron, preferably in a range of from 1 nanometers to 300 nanometers, although this is not a requirement.

In at least some cases, the layer may further comprise elemental titanium (i.e., titanium atoms having an oxidation number of zero, $Ti^0$). Without wishing to be bound by theory, the elemental titanium is believed to originate by some unidentified chemical reaction of the titanium dioxide that occurs during the rubbing process. The amount of elemental titanium may be sufficient that it can be detected by X-ray diffraction analysis along with the titanium dioxide. Typically, the concentration of elemental titanium in such embodiments declines with increasing distance from the surface of the aluminum substrate. In some preferred embodiments, the layer comprises or consists essentially of titanium dioxide and optionally at least one of elemental titanium and aluminum oxide.

Various exemplary applications of composite articles according to the present disclosure include their incorporation in solar cells (e.g., a dye-sensitized Gratzel cell), their use in anti-reflective aluminum articles, as photocatalytic membrane or support to remove airborne volatile organic compounds (VOCs) with mild ultraviolet light (UV) exposure.

SELECT EMBODIMENTS OF THE PRESENT DISCLOSURE

In a first embodiment, the present disclosure provides a method comprising rubbing a powder comprising titanium dioxide particles against a surface of an aluminum substrate to form a layer bonded to the surface of the aluminum substrate, wherein the powder is essentially free of organic particles, and wherein the layer comprises titanium dioxide.

In a second embodiment, the present disclosure provides a method according to the first embodiment, wherein the titanium dioxide particles have a median particle diameter $D_{50}$ of between 10 and 1000 nanometers, inclusive.

In a third embodiment, the present disclosure provides a method according to the first or second embodiment, wherein the powder consists essentially of the titanium dioxide particles.

In a fourth embodiment, the present disclosure provides a method according to any one of the first to third embodiments, wherein the titanium dioxide consists essentially of anatase.

In a fifth embodiment, the present disclosure provides a method according to any one of the first to third embodiments, wherein rubbing comprises buffing using a buffing pad.

In a sixth embodiment, the present disclosure provides a method according to any one of the first to fifth embodiments, wherein the layer further comprises elemental titanium.

In a seventh embodiment, the present disclosure provides a method according to any one of the first to sixth embodiments, wherein the aluminum substrate comprises aluminum foil.

In an eighth embodiment, the present disclosure provides a composite article comprising a layer bonded to a surface of a substrate, wherein the layer comprises titanium dioxide and elemental titanium, wherein the layer is essentially free of organic components, and wherein the substrate comprises aluminum metal.

In a ninth embodiment, the present disclosure provides a method according to the eighth embodiment, wherein the layer has a concentration of the elemental titanium that decreases with increasing distance from the surface of the substrate.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Examples 1A-1E $TiO_2$ powder (primary particle size=20 nm) available as AEROXIDE $TiO_2$ P25 from Evonik Degussa Corp, Parsippany, N.J., was spread on an aluminum foil (12.5 microns thick, alloy 1145, H19 temper, commercially available from All Foils Inc., Strongsville, Ohio) which was attached to a glass plate with pressure-sensitive adhesive tape. Using a paint pad (available as SHUR LINE DECK FINISHING REFILL from Shur-Line Corp., Huntersville, N.C.) fixed to the underside of a random orbital sander (MAKITA 6" FINISHING SANDER from Makita Canada Inc., Whitby, Ontario, Canada) using setting 2, the aluminum foil was polished with the $TiO_2$ powder for fixed lengths of time according to the method described in U.S. Pat. No. 6,511,701 (Divigalpitiya et al.) in column 15; lines 2 to 13.

At the end of each time period, loose powder was blown away from the foil with ionized air. This procedure was carried out 8 seconds (Example 1A), 15 seconds (Example 1B), 30 seconds (Example 1C), 45 seconds (Example 1D) and 60 seconds (Example 1E) on different specimens of the aluminum foil to make coatings of different thickness. The process produced a series of $TiO_2$-coated aluminum foil samples that were characterized with several techniques.

Figure 3:
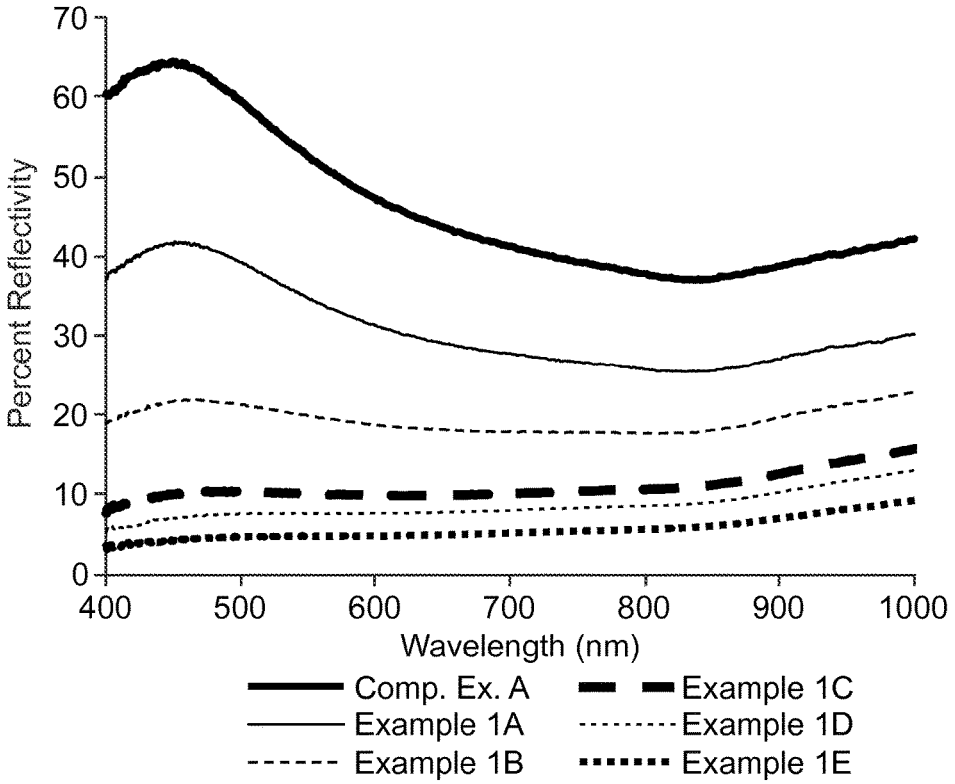
FIG. 3 is a plot of Percent Reflectivity vs. Wavelength for Comparative Example A and Examples 1A-1E.
Figure 4:
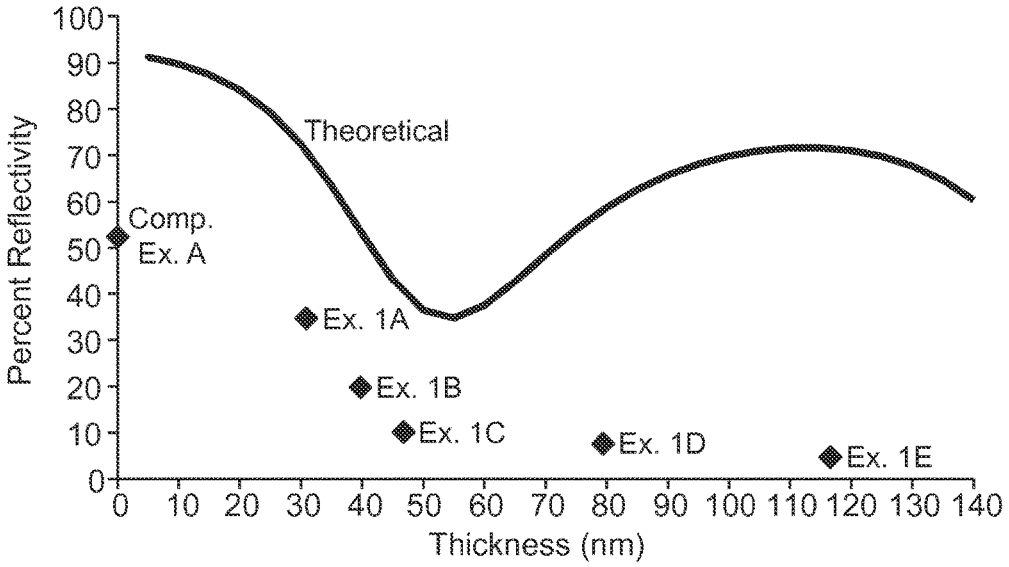
FIG. 4 is a plot of Percent Reflectivity vs. thickness for Comparative Example A and Examples 1A-1E.

FIGS. 2A-2E show scanning electron microscopy (SEM) micrographs of the coatings after 8 seconds, 15 seconds, 30 seconds, 45 seconds, and 60 seconds of rubbing, respectively. The SEM micrographs show that more deposit occurs on the grooves in the foil created in the rolling process used to manufacture the aluminum foil. Visually by eye, the coatings appeared to be very uniform. Optical reflection spectra of the coatings are shown in FIG. 3 for all the samples. The reflection spectra were obtained using a model UV-20 thickness monitor from Filmetrics, San Diego, California, which fits the data with an optical model to calculate the thickness of the coating. The thickness obtained from the spectra with the measured reflectivity at 550 nm is reported in Table 1 and FIG. 4. In FIG. 4, the solid line shows the theoretical reflectivity for a coating on a smooth surface. FIGS. 3 and 4 show that with longer rubbing times, thicker layers are obtained. Also, as with other oxide coatings of high refractive index on metals, the optical reflectivity can be varied with thickness of the coating.

As can be predicted with optical modeling, this single coating can be tuned to minimize reflectivity of aluminum metal, thus providing a simple anti-reflecting coating (FIG. 4).

A calculated R vs. thickness for a perfectly smooth coating of a material with refractive index of about n=2.6 on aluminum metal is shown in FIG. 4. The measured R has a large offset from the theoretical curve since the actual coatings are very rough and the roughness seems to increase with thickness. Also, the aluminum substrate is not smooth either. The thickness for an anti-reflective coating is given by n·d=/4 where=550 nm, which gives a value for the thickness of coating at minimum reflectivity to be about 52 nm.

TABLE 1

| EXAMPLE | RUBBING TIME, seconds | CALCULATED LAYER THICKNESS, nanometers | PERCENT REFLECTIVITY AT 550 NANOMETERS |
|---|---|---|---|
| CONTROL | 0 | 0 | 52.4 |
| 1A | 8 | 30.9 | 34.7 |
| 1B | 15 | 39.7 | 19.8 |
| 1C | 30 | 46.7 | 10.1 |
| 1D | 45 | 79.4 | 7.6 |
| 1E | 60 | 116.6 | 4.7 |

The $TiO_2$-containing layer of Example 1C was analyzed using x-ray photoelectron spectroscopy (or ESCA) depth profiling using the following analysis conditions:

ESCA Instrumentation: All spectra were taken using a PHI VERSAPROBE 5000 ESCA system which utilizes a monochromatic $AlK_\alpha$ x-ray excitation source and a hemispherical electron energy analyzer operated in a constant pass energy mode.

Photoelectron Take-Off Angle: The photoelectron collection (take-off) angle was 45°, measured with respect to the sample surface with a ±20° solid angle of acceptance.

X-Ray Excitation Source: $AlK_\alpha$/50 Watts /≈200 um Diameter Analysis Area

Charge Neutralization: Low Energy $e^-$ & $Ar^+$

Analysis Chamber Pressure: $\approx 2\times10^{-8}$ Torr

Quantitation: Compositions (reported in atom %) were calculated from survey spectra using Shirley backgrounds.

$Ar^+$ Ion Gun Etch Conditions: 2 KeV Beam Energy /2 μA Beam Current/2 mm×2 mm Raster Area $Ar^+$ Ion Beam Etch Rate: Approximately 10 nm/min As measured on thermal $SiO_2/Si^o$ Reference Wafer The ESCA analysis showed that the layer containing $TiO_2$ also contained elemental titanium) ($Ti^0$), $Al_2O_3$, and elemental aluminum ($Al^0$). The appearance of elemental titanium in the coating is completely unexpected.

Figure 5:
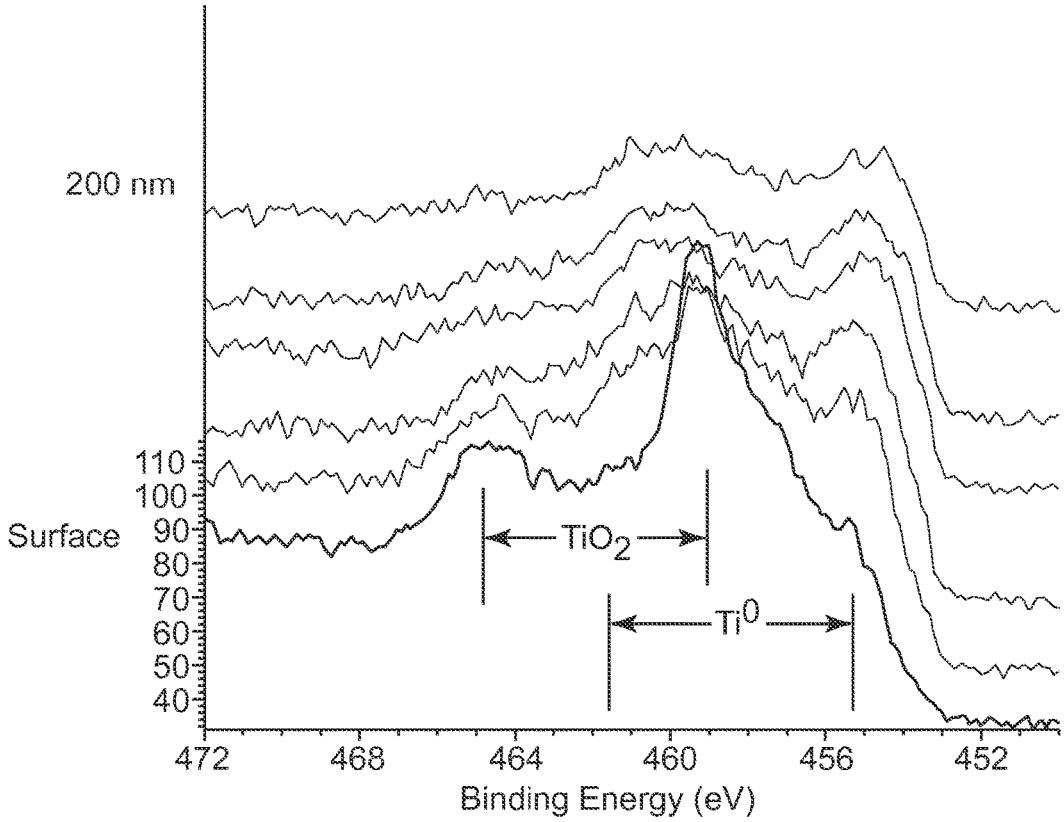
FIG. 5 shows overlaid $Ti(2p_{3/2,1/2})$ photoelectron spectra taken at various distances from the surface of the metal substrate.

FIG. 5 shows x-ray photoelectron spectroscopy depth profiling spectra of Example 1C. The concentration of elemental titanium increases as the coating depth is probed deeper as indicated by the increase in peak intensity.

All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method comprising rubbing a powder comprising titanium dioxide particles against a surface of an aluminum substrate to form a layer bonded to the surface of the aluminum substrate, wherein the powder is essentially free of organic particles, and wherein the layer comprises titanium dioxide.

2. The method of claim 1, wherein the titanium dioxide particles have a median particle diameter $D_{50}$ of between 10 and 1000 nanometers, inclusive.

3. The method of claim 1, wherein the powder consists essentially of the titanium dioxide particles.

4. The method of claim 1, wherein the titanium dioxide consists essentially of anatase.

5. The method of claim 1, wherein rubbing comprises buffing using a buffing pad.

6. The method of claim 1, wherein the layer further comprises elemental titanium.

7. The method of claim 1, wherein the aluminum substrate comprises aluminum foil.

8. A composite article comprising a layer bonded to a surface of a substrate, wherein the layer comprises titanium dioxide and elemental titanium, wherein the layer is essentially free of organic components, and wherein the substrate comprises aluminum metal.

9. The composite article of claim 8, wherein the layer has a concentration of the elemental titanium that decreases with increasing distance from the surface of the substrate.

* * * * *